US009199154B2

(12) United States Patent
Kroll

(10) Patent No.: US 9,199,154 B2
(45) Date of Patent: Dec. 1, 2015

(54) PITCHING MACHINE

(71) Applicant: Wayne L. Kroll, Fort Atkinson, WI (US)

(72) Inventor: Wayne L. Kroll, Fort Atkinson, WI (US)

( * ) Notice: Subject to any disclaimer, the term of this patent is extended or adjusted under 35 U.S.C. 154(b) by 89 days.

(21) Appl. No.: 13/921,368

(22) Filed: Jun. 19, 2013

(65) Prior Publication Data

US 2013/0333679 A1 Dec. 19, 2013

Related U.S. Application Data

(60) Provisional application No. 61/661,561, filed on Jun. 19, 2012.

(51) Int. Cl.

| | |
|---|---|
| ***A63B 71/02*** | (2006.01) |
| ***A63B 69/00*** | (2006.01) |
| ***A63B 69/40*** | (2006.01) |
| ***F41B 3/03*** | (2006.01) |

(52) U.S. Cl.

CPC ..... *A63B 69/408* (2013.01); *A63B 69/40* (2013.01); *F41B 3/03* (2013.01); *A63B 71/022* (2013.01); *A63B 2069/0008* (2013.01); *A63B 2210/50* (2013.01)

(58) Field of Classification Search

CPC ..... F41B 3/00; F41B 3/03; A63B 69/408; A63B 69/40

USPC ..... 124/7

See application file for complete search history.

(56) References Cited

U.S. PATENT DOCUMENTS

| | | | | | |
|---|---|---|---|---|---|
| 2,254,496 | A * | 9/1941 | Scally | A63B 69/40 | 124/6 |
| 4,220,130 | A * | 9/1980 | Glover | A63B 69/408 | 124/36 |
| 4,784,107 | A * | 11/1988 | Kelly | A63B 9/40 | 124/48 |
| 4,860,717 | A * | 8/1989 | Powell | A63B 69/408 | 124/17 |
| 5,439,212 | A * | 8/1995 | Hart | A63B 69/408 | 124/7 |
| 5,660,386 | A * | 8/1997 | Krieger | A63B 69/407 | 124/7 |
| 2006/0035733 | A1 * | 2/2006 | Silver | A63B 69/408 | 473/438 |
| 2007/0017498 | A1 * | 1/2007 | Finstad | F41B 11/00 | 124/84 |

* cited by examiner

*Primary Examiner* — Gene Kim
*Assistant Examiner* — Jeffrey Vanderveen
(74) *Attorney, Agent, or Firm* — Stiennon & Stiennon

(57) ABSTRACT

The present disclosure relates to a pitching machine comprising a ball path having ball entry point and a ball exit point; a pitching arm rotatably attached to the frame comprising a first end and a second end having an arcuate hand wherein the pitching arm rotates the pitching hand; and an elastic strap connected to a first end of the pitching arm and connected to the frame wherein the elastic strap activates the pitching and wherein the pitching arm is manually rotated to a first position defined by a stop such that a ball inserted at the entry point to the ball path will interact with the pitching arm and wherein the elastic strap biases the pitching arm from the first position to the second position propelling the ball along the ball path toward the ball exit.

9 Claims, 8 Drawing Sheets

PITCHING MACHINE

PRIORITY

This application claims priority to U.S. Provisional Application 61/661,561 filed on Jun. 19, 2012, which is incorporated herein by reference in its entirety.

BACKGROUND

1. Field of the Invention

The present disclosure relates to a baseball pitching machine. More particularly, it relates to an arm pitching machine.

2. Related Art

Pitching machines are commonly used for batting practice so as to not overwork pitching arms, including coaches' arms. Disc or wheel driven machines are the most common type of pitching machines. They typically use on rotating wheel or two counter-rotating wheels to engage and propel a baseball. The other principle type of pitching machine use an elongated arm that rotates about an axis. Arm pitching machines typically store energy in a spring that is rapidly released to propel the arm and a ball. Arm pitching machines are less prevalent than rotating wheel pitching machines, but are generally preferred by hitters because their throwing and release motions more closely approximates live pitching.

Professional and amateur baseball players commonly take batting practice using plastic balls, which are much lighter than real balls. These plastic balls are typically hollow and may be solid or have holes on one or both halves of the balls. Plastic balls are advantageous because they do not carry as far when hit or can be hit into backstops, which would be permanently damaged if normal balls (e.g., hardballs or softballs) were used. The balls are used pitched normally or tossed softly. Unfortunately, such methods do not accurately simulate real hitting because plastic balls lose velocity more rapidly than hardballs. Thus, batting practice using plastic balls does not aid the hitter in critical areas of batting, such as timing and bat speed.

Plastic baseballs are sometimes used for batting practice. They have the advantage of having less mass and not carrying as far as real balls making it safe to use them around buildings and spectators or in a more confined space. Conventional pitching machines are generally not compatible with plastic balls because of the difference in weight of the balls. Hollow plastic balls are also less durable than real balls and can be damaged by some conventional pitching machines. Thus, there is a need for a pitching machine that is compatible with plastic balls and that more accurately simulates real pitching.

OUTLINE OF BASIC & OTHER ADVANTAGEOUS FEATURES

It would be desirable to provide a pitching machine or the like of a type disclosed in the present application that includes any one or more of these or other advantageous features:

That can throw balls at different speeds;

That is lightweight and portable;

That is easy to operate; and

That is inexpensively manufactured and operated.

These and other features and advantages of various embodiments of systems and methods according to this invention are described in, or are apparent from, the following detailed description of various exemplary embodiments of various devices, structures, and/or methods according to the present disclosure.

SUMMARY

An exemplary embodiment relates to a pitching machine for pitching a ball to a batter comprising a frame comprising a ball path having two sides and a base with a slot, a ball entry point adapted for placing a ball in a first position in the ball path, and a ball exit point at an end of the ball path; a pitching arm rotatably attached to the frame comprising a first end and a second end having an arcuate hand passing through the slot in the ball path wherein the pitching arm rotates the pitching hand between a first position, a rest position, and a second position; and an elastic strap connected to a first end of the pitching arm and connected to the frame wherein the elastic strap biases the pitching arm and hand to the rest position and away from the first position and away from the second position and wherein the pitching arm is manually rotated to a first position defined by a stop such that a ball inserted at the entry point to the ball path will interact with the pitching arm and wherein the elastic strap biases the pitching arm from the first position to the second position propelling the ball along the ball path toward the ball exit.

These and other features and advantages of various embodiments of systems and methods according to this invention are described in, or are apparent from, the following detailed description of various exemplary embodiments of various devices, structures, and/or methods according to the present disclosure.

BRIEF DESCRIPTION OF THE DRAWINGS

Various exemplary embodiments of the systems and methods according to the present disclosure will be described in detail, with reference to the following figures, wherein.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION OF THE EXEMPLARY EMBODIMENTS

The present disclosure relates to a pitching machine with a throwing arm. In various exemplary embodiments, the disclosed pitching machine includes a pitching arm activated by an elastic strap. In various exemplary embodiments, the pitching arm propels a ball along a channel having a bottom surface and two side walls.

For purposes of clarity and consistency, reference terms such as right and left are used from the reference point of a person operating the machine as described below. As described in the embodiment shown in the associated drawings, the operator stands at the rear or back end of the pitching machine. The pitching arm is accessed through an opening in the left side of the pitching machine. The ball is inserted through another opening in the top of the pitching machine. The ball exits the pitching machine at its front end, which is the end closest to the hitter.

Figure 1:
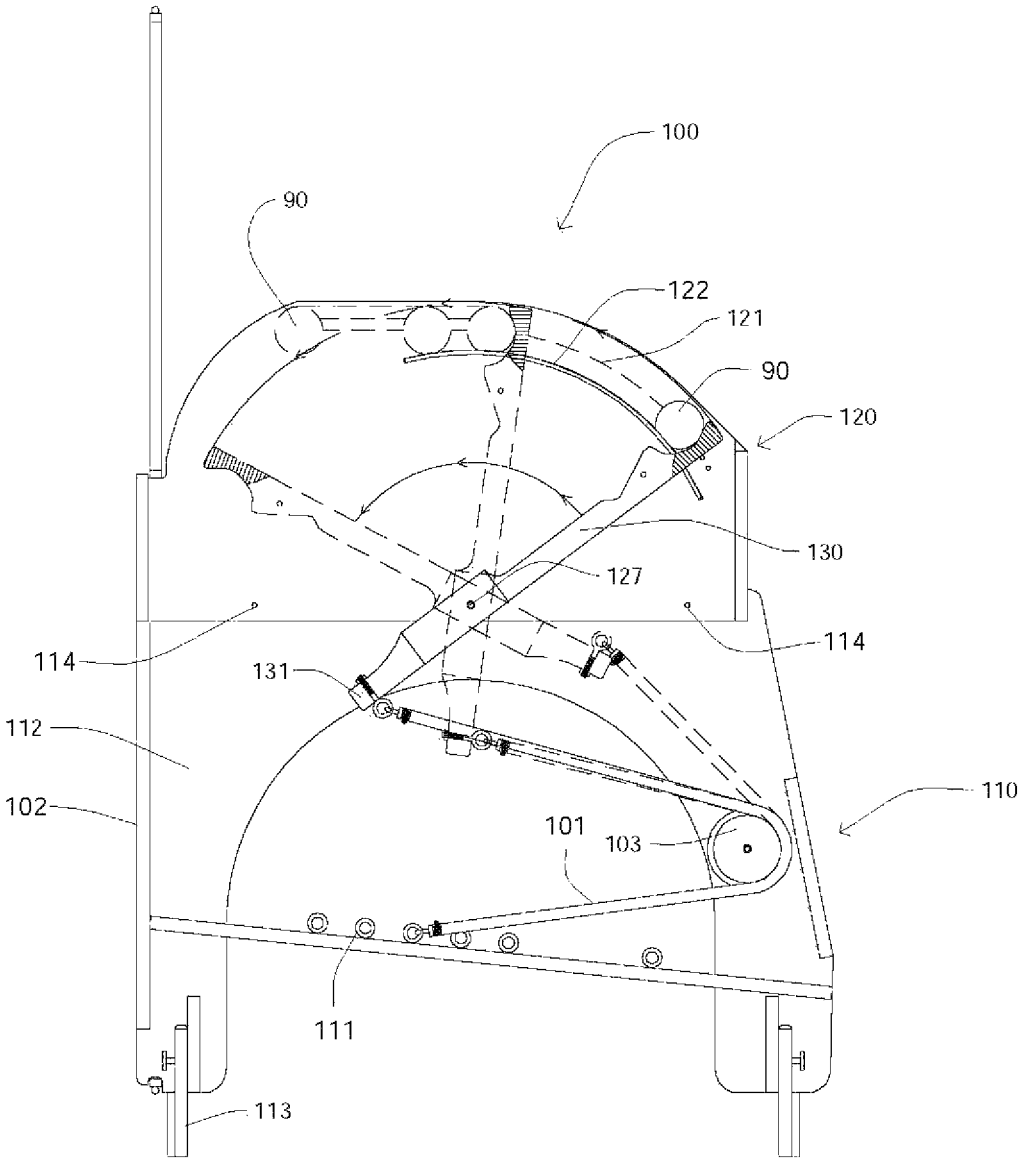
FIG. 1 is a side view of an exemplary embodiment of a pitching machine according to the present disclosure.

In various exemplary embodiments, as shown in FIG. 1, the disclosed pitching machine 100 comprises a base 110 for a pitching module 120. In various exemplary embodiments, a throwing arm 130 is pivotally or rotatably attached to the pitching module 120. In various exemplary embodiments, a first end 131 of the pitching arm 130 is attached to an elastic strap or tube 101, which is anchored to a connection point 111 on the pitching machine 100. In various exemplary embodiments, the strap 101 comprises an elastomeric material capable of storing and releasing energy by repeatedly stretching and returning to its original shape or length. In various exemplary embodiments, the elastomeric tube 101 passes over at least one pulley 103.

Figure 2:
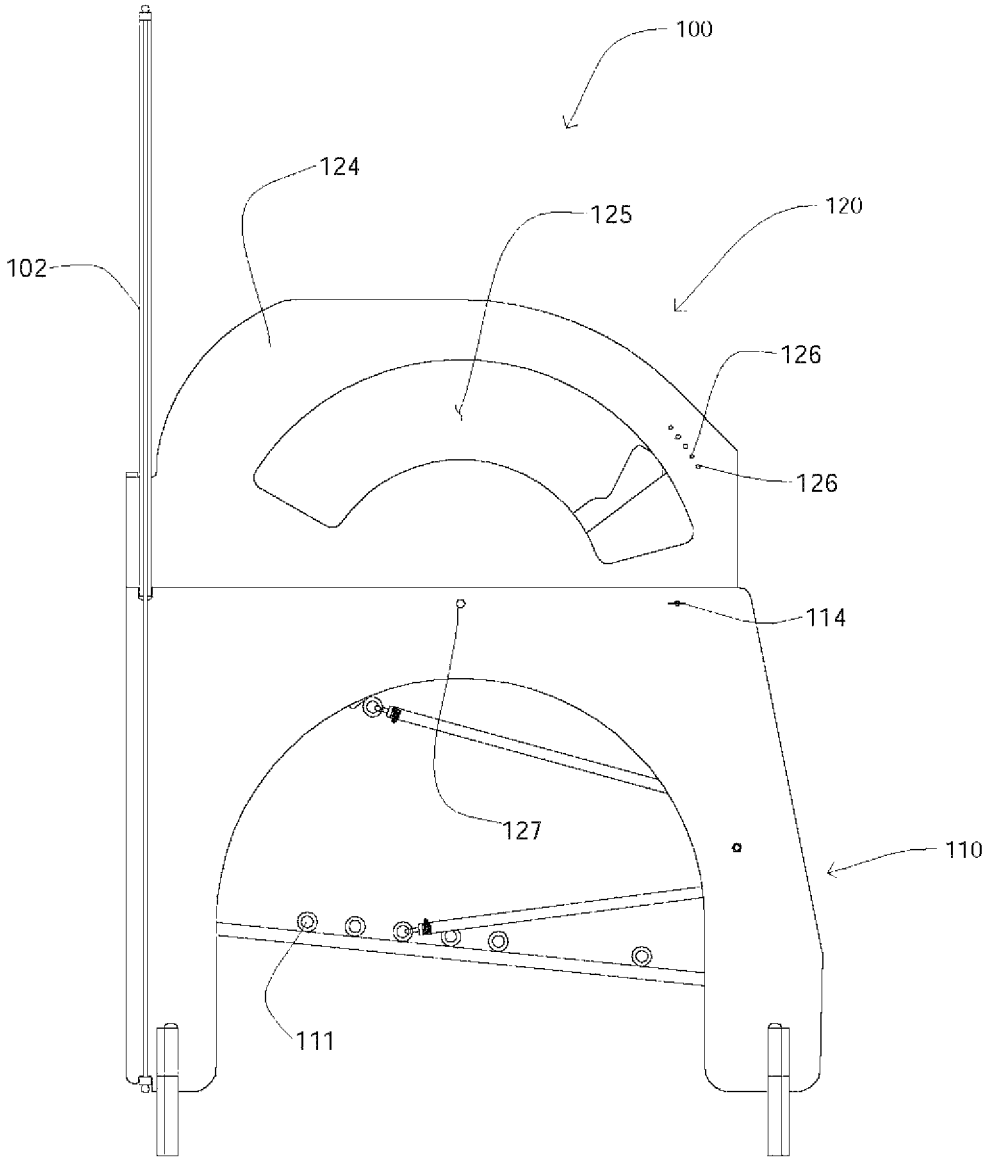
FIG. 2 is a side view of the embodiment of FIG. 1.
Figure 3:
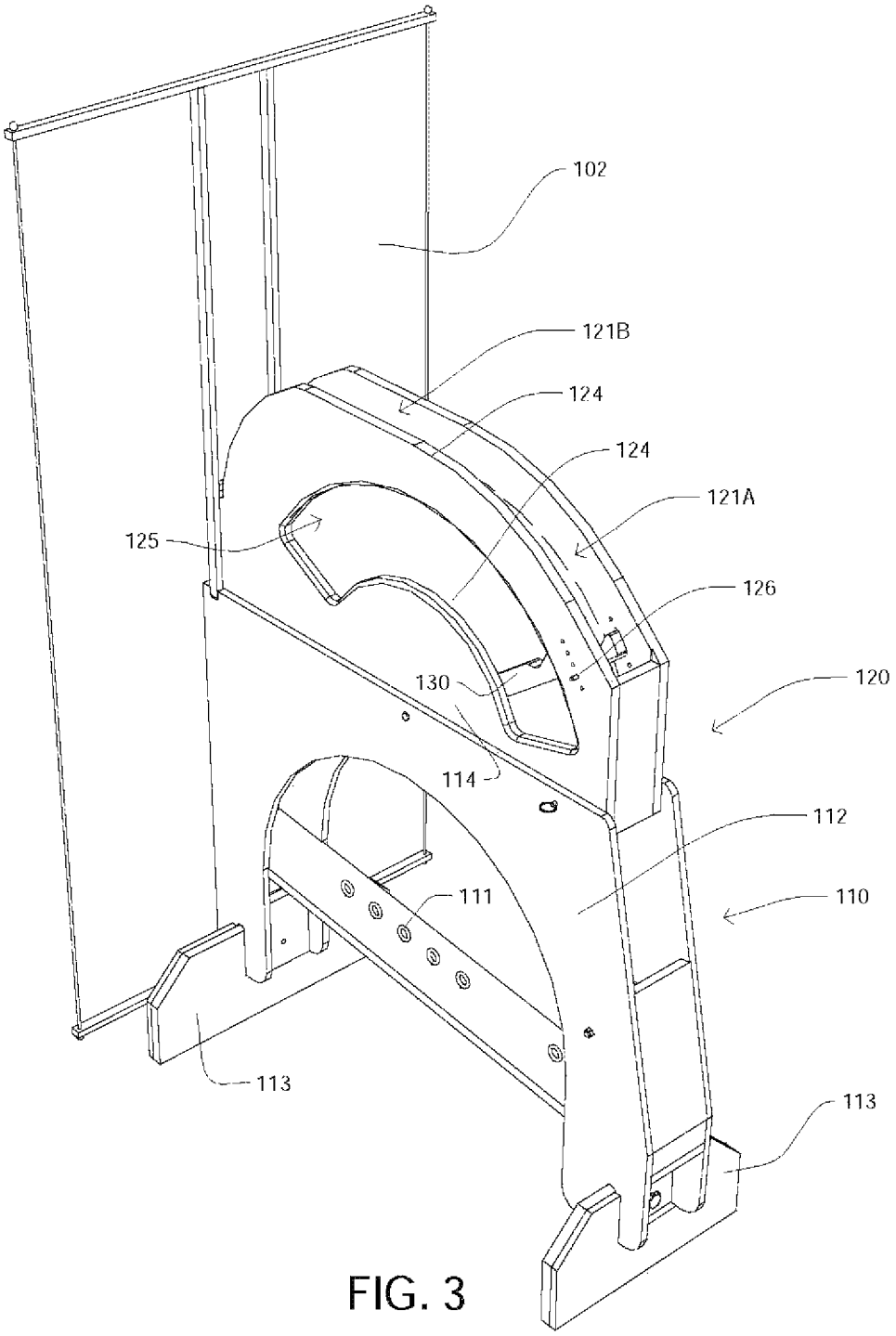
FIG. 3 is a isometric view of the embodiment of FIG. 1.

In various exemplary embodiments, as shown in FIGS. 1-3, a support frame 110 comprises at least two vertical supports 112 and at least one horizontal support 113. In various exemplary embodiments, the horizontal supports 113 are detachably attached to the vertical supports 112.

In various exemplary embodiments, as shown in FIGS. 2-3, the disclosed pitching machine 100 includes a base 110. In various exemplary embodiments, as shown in FIG. 1, the base 110 comprises one or more strap connection points 111 for the elastic strap 101. Multiple connection points 111 (e.g., hooks or loops) allow the elastic strap 101 to be connected at different distances from the pitching arm 130, which makes the tension on the strap 101 adjustable. In various exemplary embodiments, the support frame 110 is adapted to couple with and support a pitching module 120.

Figure 4:
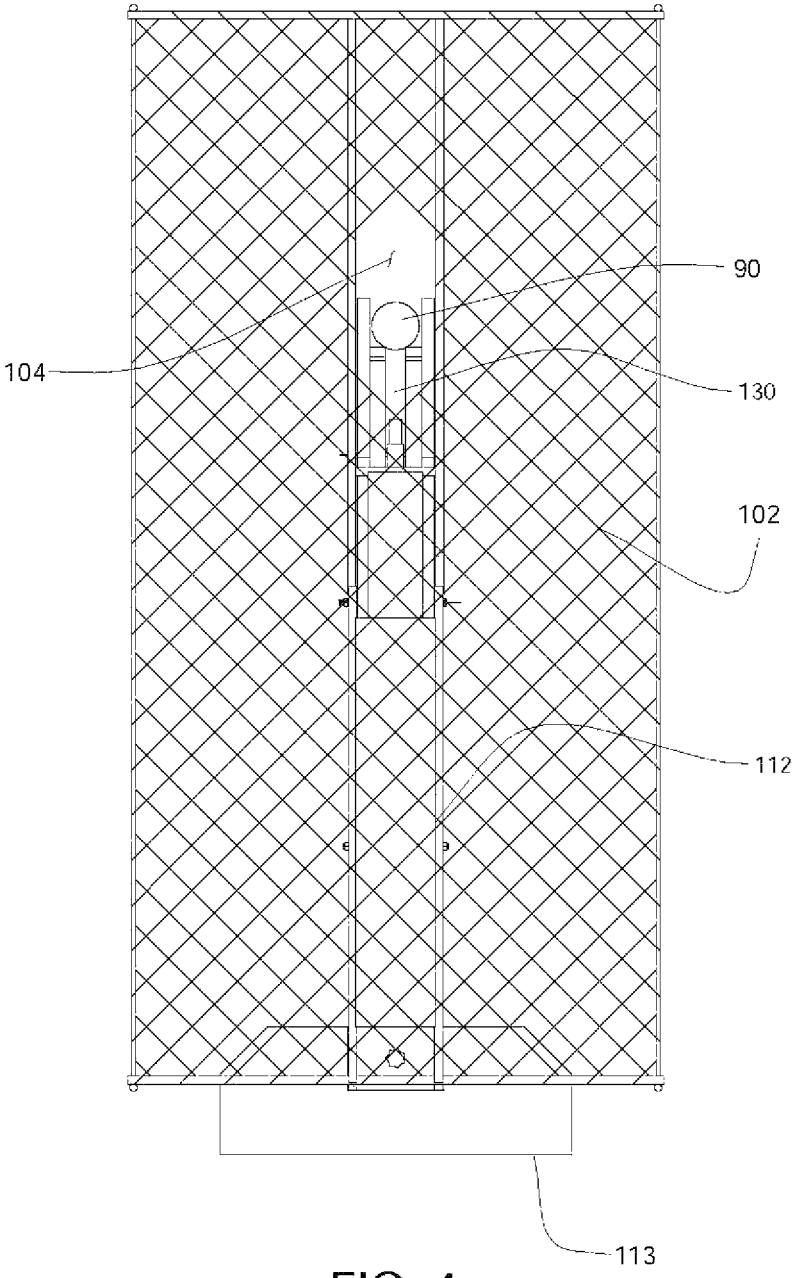
FIG. 4 is a front view of the embodiment of FIG. 1.

In various exemplary embodiments, as shown in FIGS. 3-4, the pitching machine 100 further comprises a shield 102 (e.g., protective netting) in front of the pitching machine 100 to protect the operator from batted balls. In various exemplary embodiments, as shown in FIG. 4, the protective barrier 102 comprises netting attached to a frame that is preferably detachably attached to the pitching machine 100 and includes a small opening 104 through which the ball 90 may pass.

Figure 5:
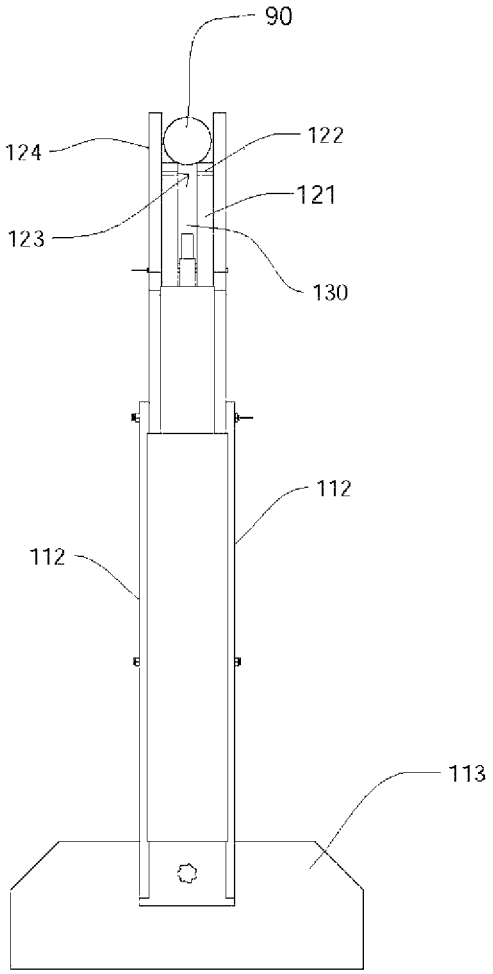
FIG. 5 is a front view of the embodiment of FIG. 1.

In various exemplary embodiments, as shown in FIGS. 1-3, a pitching module 120 comprises a partially enclosed space containing a pitching arm 130 pivotally or rotatably attached to the pitching module. In various exemplary embodiments, a second end 132 of the pitching arm extends into a ball channel 121 defined by a bottom surface 122 with a gap 123 for the pitching arm 130 and two sidewalls 124. In various exemplary embodiments, as shown in FIG. 2, a slot 125 is provided in a side 124 of the pitching module 120 to provide access to the pitching arm 130. In various exemplary embodiments, as shown in FIGS. 3-5, the top of the ball channel 121 is uncovered and the ball 90 may be dropped into the ball channel 121 above the pitching arm 130. In various other exemplary embodiments, the ball channel 121 may be partially covered. Alternatively, the ball 90 may be inserted into the ball channel 121 via an opening in a sidewall 124.

In various exemplary embodiments, the ball channel 121 comprises a curved portion 121A into which the ball 90 is introduced by the user and a generally straight portion 121B. In various exemplary embodiments, the curved portion may be covered or uncovered. In various exemplary embodiments, the generally straight portion of the ball channel 121 is not covered. As the ball 90 travels down the ball channel 121 into the straight portion, the ball 90 will tend to rise up off of the bottom surface(s) 122 of the ball channel 121, but will be still be restrained by the side walls 124.

FIG. 1 illustrates the operation of an exemplary embodiment of a pitching machine 100 according to the present disclosure. In various exemplary embodiments, the pitching arm 130 is accessed via slot 125 and pulled back to a stop point 126. In various exemplary embodiments, the arm stop 126 comprises a peg inserted through one or two holes in the side walls 124 of the ball path 121. In various exemplary embodiments, the stop 126 is adjustable so that the arm 130 stops at a point with greater or lesser tension on the elastic strap 101. A ball 90 is inserted into the pitching channel 121 and rests upon the pitching arm 130. The pitching arm 130 is released and returns towards its equilibrium position (e.g., the point of minimum tension on the elastic strap). The movement of the pitching arm 130 propels the ball 90 along and out of the ball channel 121.

In various exemplary embodiments, the strap 101 comprises a latex tube (e.g., surgical tubing) approximately 21.5 inches (±about 0.5 inches) in untensioned length. In various exemplary embodiments, the tube 101 is stretched to approximately 46 to approximately 57 inches in length depending on where the tube 101 is connected to the base 110 and the chosen arm stop 126. In various exemplary embodiments, a strap hoop 111 that does not tension the strap 101 may be included for when the machine is not in use. The speed of the pitched ball is a function of the force applied to stretching the strap 101. Radar gun tests have shown that the ball exits the pitching machine at about 70 to 84 mph depending on the selected arm stop 126 and strap hoop 111. In various exemplary embodiments, the batter is positioned at a distance from the machine that requires approximately the same response time as a batter facing live pitching. For example, a ball pitched at 80 mph from 30 feet away would simulate a 90 mph pitch thrown from regulation distance of 60 feet 6 inches.

Figure 6:
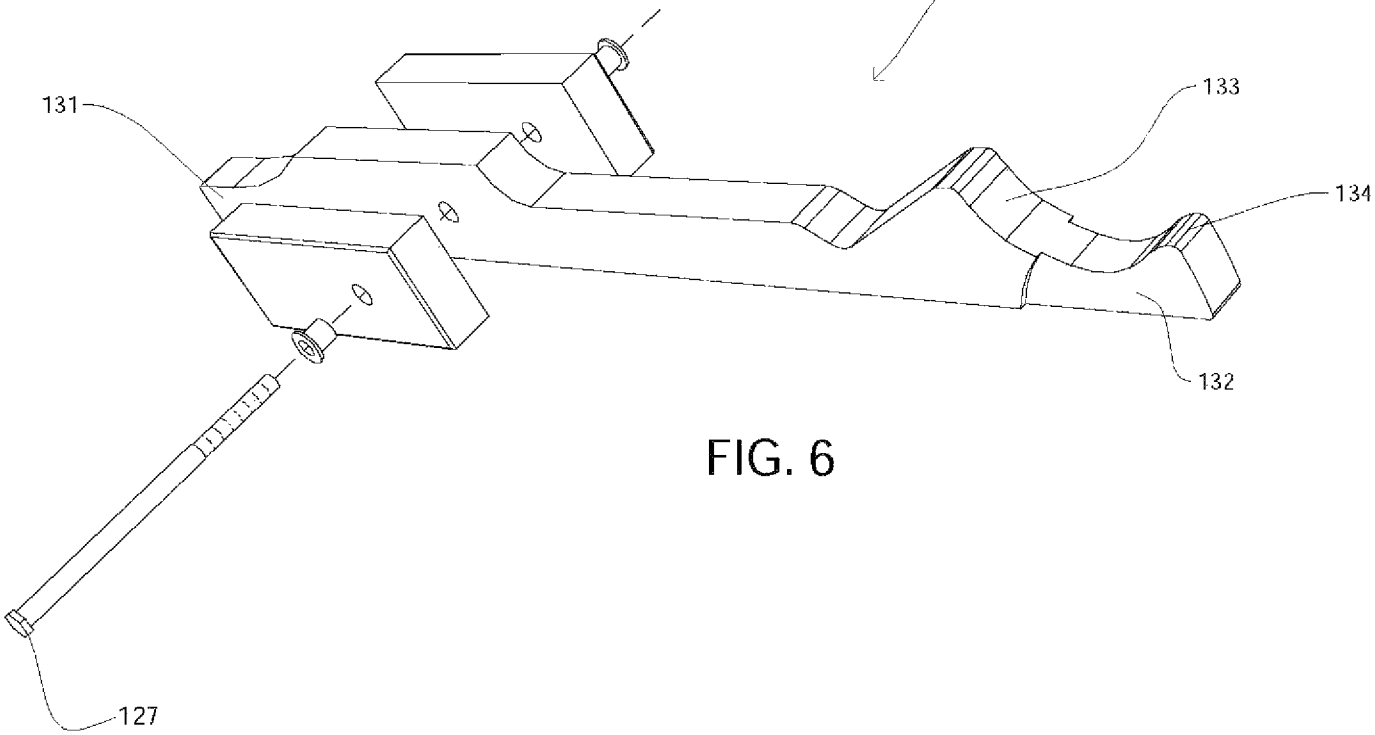
FIG. 6 is an exploded isometric view of an exemplary embodiment of a pitching arm according to the present disclosure.

In various exemplary embodiments, a first end 131 of the pitching arm 130 is attached to an elastic strap 101. In various exemplary embodiments, as shown in FIG. 6, a concave arcuate portion 133 near the second end 132 of the pitching arm 130 is positioned to interact with the ball 90. In various exemplary embodiments, as shown in FIG. 6, the arcuate portion is curved with a radius of curvature having a vertical axis. In various exemplary embodiments, the upper or distal end of the pitching arm and/or arcuate portion comprises a relatively high-friction surface or finger 134 (e.g., emery board, sand paper, or other coarse surface or material) to impart greater spin to the ball 90 as it separates from the pitching arm 130.

Figure 7:
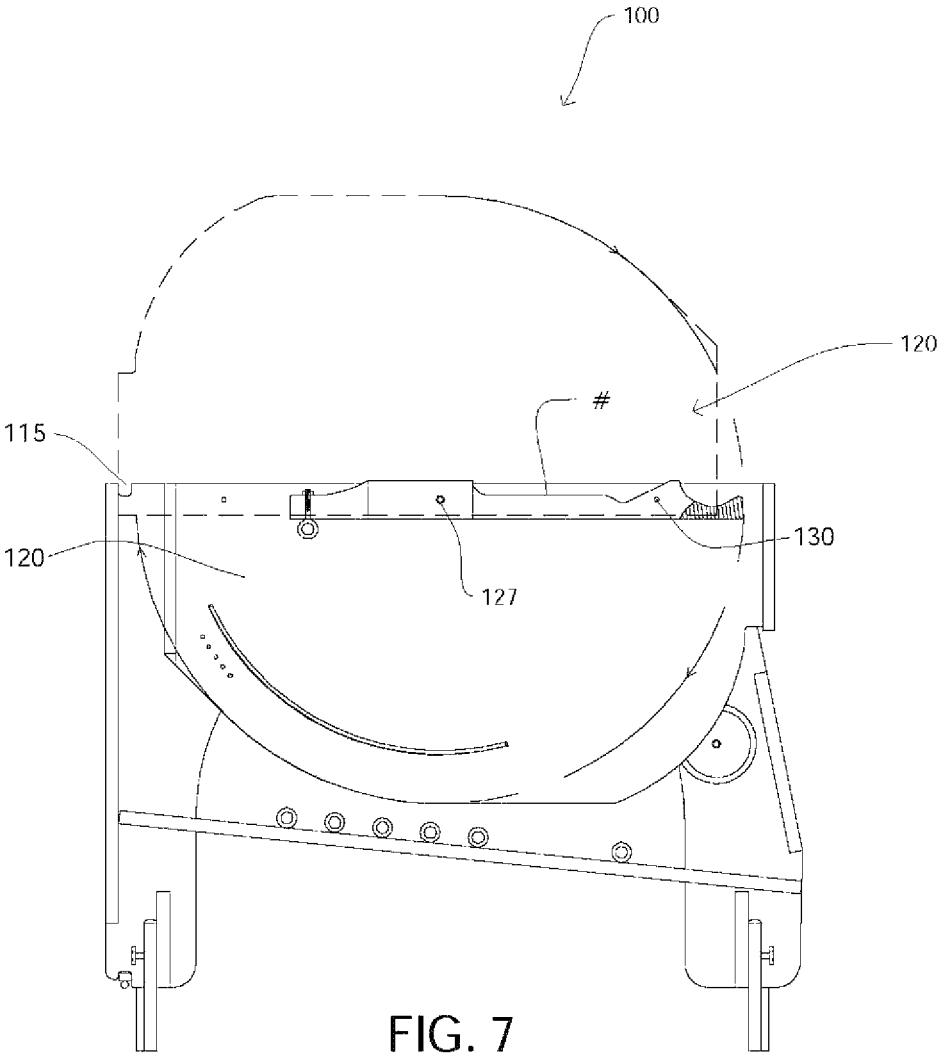
FIG. 7 is a side view of the embodiment of FIG. 1.
Figure 8:
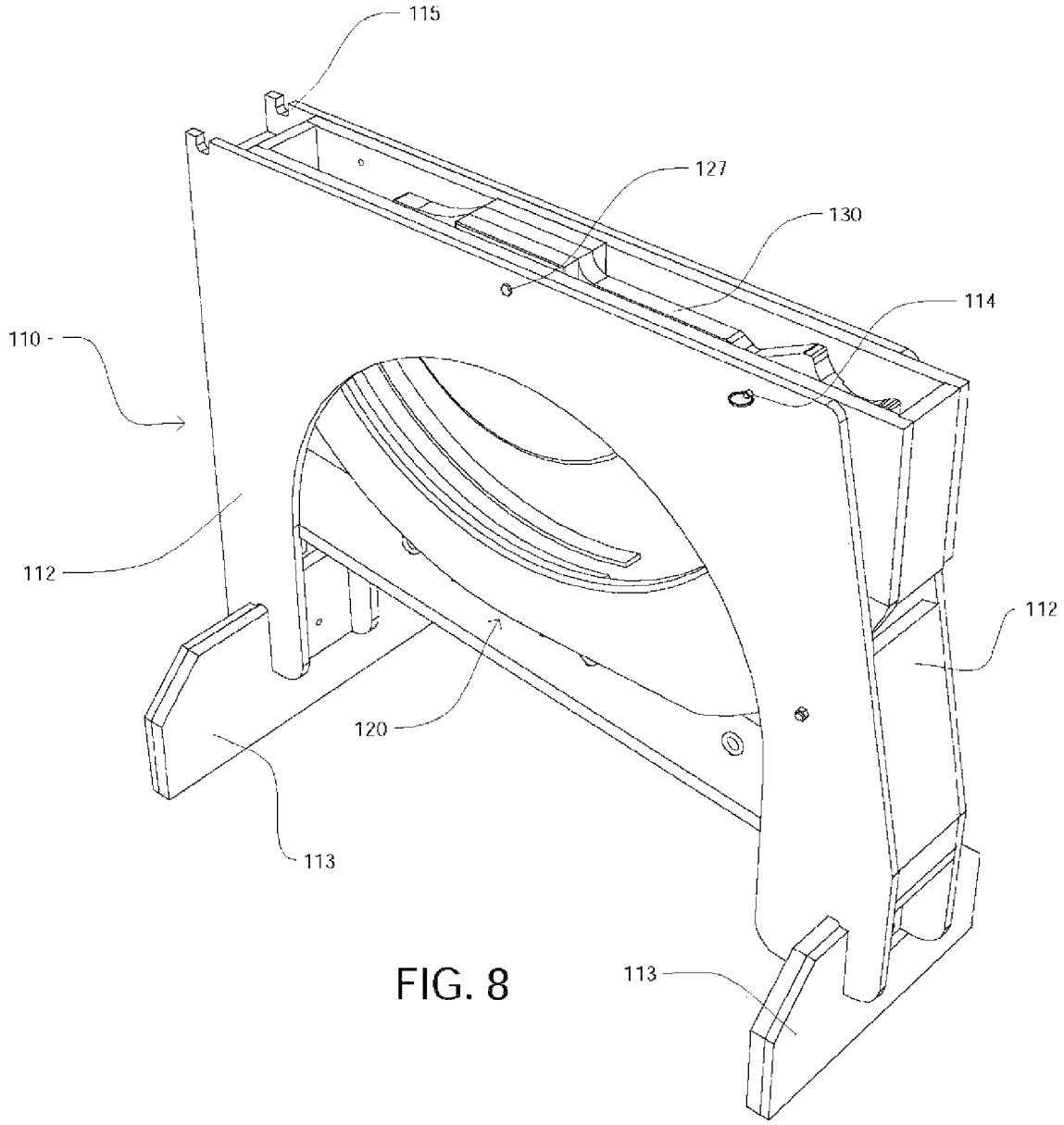
FIG. 8 is an isometric view of the embodiment of FIG. 1.

In various exemplary embodiments, as shown in FIGS. 7-8, the pitching module 120 rotates or pivots relative to the base 110 between an operational configuration and a storage/transport configuration. According to various exemplary embodiments, in a storage/transport configuration, the pitching module 120 rotates down into the base 110 such that the overall dimensions of the pitching machine 100 become approximately those of the base 110.

In various exemplary embodiments, as shown in FIGS. 7-8, the pitching machine 100 comprises two notches 115 adapted for mating with a protective shield or net 102.

In various exemplary embodiments, the ball used is hollow and formed from a rigid plastic. In various exemplary embodiments, the ball may include openings in either a symmetrical or asymmetrical pattern. In various exemplary embodiments, the ball may be evenly weighted (e.g., composed of material with a uniform density and thickness).

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be appreciated that the construction and arrangement of the pitching machine, as shown in the various exemplary embodiments, is illustrative only. While the pitching machine, according to this invention, has been described in conjunction with the exemplary embodiments outlined above, various alternatives, modifications, variations, improvements, and/or substantial equivalents, whether known or that are or may be presently unforeseen, may become apparent. Accordingly, the exemplary embodiments of the pitching machine, according to this invention, as set forth above, are intended to be illustrative, not limiting. Various changes may be made without departing from the spirit and scope of the invention. Therefore, the description provided above is intended to embrace all known or later-developed alternatives, modifications, variations, improvements, and/or substantial equivalents.

What is claimed is:

1. A pitching machine for pitching a ball to a batter, comprising:

a frame having a first upwardly extending wall spaced sidewardly from a second upwardly extending wall;

a first track segment;

a second track segment, wherein the first and second track segments are fixed between the first and second side walls and spaced sidewardly from one another to define a gap therebetween, a ball channel being defined between the upwardly extending walls above the first and second track segments;

a pitching arm rotatably mounted to the frame to rotate about a first axis, the pitching arm extending from the first axis in a radial direction to a hand segment, wherein the arm extends radially through the gap such that the hand segment projects above the track segments;

a biasing member which extends between the frame and the arm to bias the arm in a frontward direction; and portions of the pitching arm hand segment which define a frontwardly opening concave surface portion which is continuous with a frontwardly facing distal convex portion which extends radially outwardly from the concave surface portion, such that the arm when released engages the ball within the ball channel, thereby propelling the ball along and out of the ball channel, with spin imparted to the ball as it traverses the distal convex portion and separates from the pitching arm.

2. The pitching machine of claim 1 further comprising:

portions of the first side wall which define a hand opening which extends beneath the first track segment, the hand opening communicating with an exterior of the pitching machine; and grip portions of the pitching arm positioned between the first axis and the hand segment which extend within the hand opening, such that the grip portions are accessible from exterior of the pitching machine such that an operator may engage the grip portions and pivot the pitching arm into a retracted position for insertion of a ball onto the arcuate track segments forward of the hand segment.

3. The pitching machine of claim 1 wherein the pitching arm hand segment concave surface portion has a radius which is greater than a radius of the pitching arm hand segment distal convex portion.

4. The pitching machine of claim 1 wherein the frame first upwardly extending wall is connected to the second upwardly extending wall, and wherein the frame upwardly extending walls are pivotally connected to a base, such that the upwardly extending walls can be rotated to extend within the base in a storage position.

5. The pitching machine of claim 1 wherein pitching arm has a first end positioned opposite the hand segment, such that the first axis is between the first end and the and hand segment, and wherein the biasing member comprises an elastic member extending between the pitching arm first end and the frame.

6. A pitching machine for pitching a ball to a batter, comprising:

a frame having a first upwardly extending wall spaced sidewardly from a second upwardly extending wall;

a first track segment;

a second track segment, wherein the first and second track segments are fixed between the first and second side walls and spaced sidewardly from one another to define a gap therebetween;

a pitching arm rotatably mounted to the frame to rotate about a first axis, the pitching arm extending from the first axis in a radial direction to a hand segment, wherein the arm extends radially through the gap such that the hand segment projects above the track segments between the frame first wall and second wall;

a biasing member which urges the pitching arm to pivot about the first axis from a rear position to a forward position, wherein the pitching arm hand segment traverses a path as it is moved from the rear position to the forward position, and wherein an upper opening is defined between the frame first wall and second wall above the hand segment path, such that a ball placed on the first and second track segments is propelled by the pitching arm hand segment to move forward, and wherein the hand segment as it travels along the path releases the ball upwardly through the upper opening at a release point, and the hand segment travels past the release point along the path; and wherein the frame first upwardly extending wall is connected to the second upwardly extending wall, and wherein the frame upwardly extending walls are pivotally connected to a base, such that the upwardly extending walls can be rotated to extend within the base in a storage position.

7. The pitching machine of claim 6 further comprising:

portions of the first side wall which define a hand opening which extends beneath the first track segment, the hand opening communicating with an exterior of the pitching machine; and grip portions of the pitching arm positioned between the first axis and the hand segment which extend within the hand opening, such that the grip portions are accessible from exterior of the pitching machine such that an operator may engage the grip portions and pivot the pitching arm into a retracted position for insertion of a ball onto the arcuate track segments forward of the hand segment.

8. The pitching machine of claim 6 wherein the pitching arm has a first end positioned opposite the hand segment, such that the first axis is between the first end and the hand segment, and wherein the biasing member comprises an elastic member extending between the pitching arm first end and the frame.

9. A pitching machine for pitching a ball to a batter, comprising:

a frame having a first upwardly extending wall spaced sidewardly from a second upwardly extending wall, to define an upper opening therebetween;

a first arcuate track segment;

a second arcuate track segment, wherein the first and second arcuate track segments are fixed between the first and second side walls and spaced sidewardly from one another to define a gap therebetween, a ball channel being defined between the first and second upwardly extending walls and above the first and second track segments;

a pitching arm rotatably mounted to the frame to rotate about a first axis, the pitching arm extending from the first axis in a radial direction to a hand segment, wherein the arm extends radially through the gap such that the hand segment projects above the arcuate track segments;

a biasing member which extends between the frame and the arm to bias the arm in a frontward direction; and portions of the pitching arm hand segment which define a frontwardly opening concave surface portion which is continuous with a frontwardly facing distal convex portion which is radially outward from the concave surface portion, such that the arm when released engages the ball within the ball channel, thereby propelling the ball along and out of the ball channel through the upper opening, with spin imparted to the ball as it traverses the distal convex portion and separates from the pitching arm.

* * * * *